US010160018B2

(12) United States Patent
Higai et al.

(10) Patent No.: US 10,160,018 B2
(45) Date of Patent: Dec. 25, 2018

(54) METHOD OF MANUFACTURING CLOSED-STRUCTURE PART AND APPARATUS FOR THE SAME

(75) Inventors: Kazuhiko Higai, Tokyo (JP); Yuji Yamasaki, Tokyo (JP)

(73) Assignee: JFE Steel Corporation (JP)

( * ) Notice: Subject to any disclaimer, the term of this patent is extended or adjusted under 35 U.S.C. 154(b) by 1108 days.

(21) Appl. No.: 14/394,192

(22) PCT Filed: Apr. 13, 2012

(86) PCT No.: PCT/JP2012/060640

§ 371 (c)(1),
(2), (4) Date: Nov. 19, 2014

(87) PCT Pub. No.: WO2013/153681

PCT Pub. Date: Oct. 17, 2013

(65) Prior Publication Data

US 2015/0101388 A1 Apr. 16, 2015

(51) Int. Cl.
*B21C 37/15* (2006.01)
*B21D 5/01* (2006.01)
(Continued)

(52) U.S. Cl.
CPC ..... *B21C 37/155* (2013.01); *B21C 37/0815* (2013.01); *B21C 37/15* (2013.01); *B21D 5/015* (2013.01); *B21D 53/88* (2013.01)

(58) Field of Classification Search
CPC ... B21C 37/155; B21C 37/156; B21C 37/158; B21C 37/0815; B21C 37/15; B21D 5/10;
(Continued)

(56) References Cited

U.S. PATENT DOCUMENTS 8,844,581 B2 * 9/2014 Higai ..... B21D 5/10 72/368
9,009,970 B2 * 4/2015 Higai ..... B21C 37/0803 72/368
(Continued)

FOREIGN PATENT DOCUMENTS

JP 09-271847 10/1997
JP 10-236248 9/1998
(Continued)

OTHER PUBLICATIONS

Supplementary European Search Report dated Nov. 3, 2015 of corresponding European Application No. 12874022.2.

*Primary Examiner* — Pradeep C Battula
(74) *Attorney, Agent, or Firm* — DLA Piper LLP (US)

(57) ABSTRACT

A method manufactures a closed-structure part by forming a flat plate-shaped workpiece into a closed structure including a bottom portion curved along a longitudinal direction. The method includes a first forming step of forming a plurality of first out-of-plane deformed portions and a bent portion, the first out-of-plane deformed portions being formed in a region of the workpiece corresponding to the bottom portion and arranged along the longitudinal direction, each of the out-of-plane deformed portions having a recessed shape or a protruding shape; and a second forming step of squashing the first out-of-plane deformed portions between a pad and a punch such that the region of the workpiece corresponding to the bottom portion is curved and bending bent portions by pressing the punch into a space between dies while the region of the workpiece corresponding to the bottom portion is clamped between the pad and the punch.

7 Claims, 11 Drawing Sheets

(51) Int. Cl.
*B21C 37/08* (2006.01)
*B21D 53/88* (2006.01)

(58) Field of Classification Search
CPC . B21D 5/015; B21D 7/06; B21D 9/04; B21D 9/05; B21D 9/055; B21D 9/08
See application file for complete search history.

(56) References Cited

U.S. PATENT DOCUMENTS

| | | | | |
|---|---|---|---|---|
| 9,162,272 | B2 * | 10/2015 | Higai | B21D 5/10 |
| 2004/0035166 | A1 | 2/2004 | Maeda et al. | |
| 2010/0218375 | A1 * | 9/2010 | Saito | B21D 5/015 29/897.2 |

FOREIGN PATENT DOCUMENTS

| | | |
|---|---|---|
| JP | 2002-192271 | 7/2002 |
| JP | 2005-177852 | 7/2005 |
| JP | 2008-200688 | 9/2008 |
| JP | 2010-115674 | 5/2010 |

* cited by examiner (a)

(b)

METHOD OF MANUFACTURING CLOSED-STRUCTURE PART AND APPARATUS FOR THE SAME

TECHNICAL FIELD

This disclosure relates to manufacturing a press-formed closed-structure part having a curved shape and that includes a bottom portion curved along the longitudinal direction by press-forming a flat plate-shaped workpiece (blank).

BACKGROUND

In the automobile industry, home electronics industry, construction industry, and the like, a press-formed closed-structure part has been manufactured by separately forming a pair of parts each having a substantially angular-U-shaped cross section and flanges at both end surfaces thereof in the cross-sectional direction; and by joining these parts together at the flanges by spot welding or continuous welding such as laser welding, to make the closed-structure part, which is a product.

To manufacture such a press-formed closed-structure part at a low cost while reducing the weight and increasing the impact-absorbing ability and rigidity of the press-formed part, methods of press-forming a single blank into a closed-structure part having a polygonal cross section have been proposed.

Japanese Unexamined Patent Application Publication No. 2010-115674 describes a method that supports the central portion of a material and press-forms a flat plate-shaped material into a shape that has a curvature when an end portion of the material is seen in a plan view and that has flange surfaces below side wall surfaces when the material is seen in a side view. Moreover, JP '674 describes that a difference in the line lengths at the end portions of the material before and after bending is substantially eliminated and an occurrence of wrinkling in the formed portion is suppressed by providing the side wall surfaces of the press-formed body with protruding beads and providing the flange surfaces directly below the side wall surfaces with recessed beads.

Japanese Unexamined Patent Application Publication No. 2008-200688 describes a press-forming apparatus that press-forms a flat plate-shaped material plate into a product that includes a curved portion curved along the longitudinal direction, extension portions extending from the curved portion in the longitudinal directions, and flanges extending sideways from the curved portion and the extension portions. The press-forming apparatus includes pressing portions to press edge portions of the material plate, which form the flanges of the curved portion, and driving means to move extension-portion forming dies in directions that residual stresses generated in the flange surfaces of the curved portion is cancelled out.

When a press-formed part having a curved surface is formed by using the technology described in JP '674, if an expression D1-D2 has a positive value when a line length (D1) of a blank-flange-corresponding portion is compared with a line length (D2) of the corresponding portion after being press-formed, or a line length before the press-forming is greater than a line length after the press-forming, wrinkling and buckling are likely to occur. To eliminate the difference in the line lengths, JP '674 provides the side wall portions with protruding beads and provides the flange surfaces directly below the side wall portions with recessed beads.

However, according to JP '674, the recessed/protruding shapes can be formed only in the side wall portions of the part and on the flange portions that are continuous with the side wall portions due to a limitation on the structure of the die. Therefore, the method of JP '674 can be used only for a part that has a curvature in a plan view (that is, a press-formed part having a linear shape in a side view). The method has another problem in that it cannot be used for a closed-structure part formed from a single blank.

JP '688 discloses a method of reducing the residual stress generated in the flange surfaces and increasing dimensional precision by press-forming a part that has a curvature in a plan view while applying a compressive load in the longitudinal directions. The method of JP '688 also has a problem in that it can be used only for a part that has a curvature in a plan view (that is, a press-formed part having a linear shape in a side view).

As described above, with existing methods, it is not possible to easily press-form a curved closed-structure part that has a curved surface at least in the bottom portion thereof.

It could therefore be helpful to provide a way to manufacture with high dimensional precision a press-formed curved closed-structure part that has a curved surface in the bottom portion thereof while reducing a manufacturing cost by reducing the number of forming steps and the number of dies.

SUMMARY (1) We provide a method of manufacturing a closed-structure part by forming a flat plate-shaped workpiece into a closed structure including a bottom portion curved along a longitudinal direction, the method including a first forming step and a second forming step.

The first forming step is a step of forming a plurality of first out-of-plane deformed portions and bent portions, the first out-of-plane deformed portions are formed at least in a region of the workpiece corresponding to the bottom portion and arranged along the longitudinal direction, each of the first out-of-plane deformed portions has a recessed shape or a protruding shape.

The second forming step is a step of squashing the first out-of-plane deformed portions between a pad and a punch and bending the bent portions by pressing the punch into a space between dies in a state while the region of the workpiece corresponding to the bottom portion is clamped between the pad and the punch.

(2) We provide a method for manufacturing a closed-structure part according to (1) by forming a flat plate-shaped workpiece into a closed structure including the bottom portion, left and right side wall portions disposed on left and right sides of the bottom portion, and a pair of joint ends that are respectively continuous with the left and right side wall portions.

In the first forming step, a plurality of second out-of-plane deformed portions are formed together with the first out-of-plane deformed portions, the second out-of-plane deformed portions are formed in regions of the workpiece corresponding to the side wall portions and arranged along the longitudinal direction, each of the second out-of-plane deformed portions has a recessed shape or a protruding shape, and the bent portions are formed at boundaries between the bottom portion and the side wall portions.

In the second forming step, the second out-of-plane deformed portions are squashed between side surfaces of the punch and side surfaces of the dies.

(3) We provide the method for manufacturing a closed-structure part according to (1) or (2), in which, after the first forming step has been finished and before the bent portion is bent in the second forming step, a bulkhead is set on the bottom portion of the workpiece.

(4) We provide an apparatus that manufactures a closed-structure part by forming a flat plate-shaped workpiece into a closed structure including a bottom portion curved along the longitudinal direction, the apparatus including a press-forming die, a pad and a punch, and dies.

The press-forming die includes an upper die and a lower die that form a plurality of first out-of-plane deformed portions and bent portions, the first out-of-plane deformed portions are formed at least in a region of the workpiece corresponding to the bottom portion and arranged along the longitudinal direction, each of the first out-of-plane deformed portions has a recessed shape or a protruding shape.

The pad and the punch squash the first out-of-plane deformed portions by clamping the bottom portion of the workpiece therebetween, and the dies bend the bent portions by pressing the punch into a space therebetween while the region of the workpiece corresponding to the bottom portion is clamped between the pad and the punch.

(5) We provide the apparatus to manufacture a closed-structure part according to (4) by forming a flat plate-shaped workpiece into a closed structure including the bottom portion, left and right side wall portions disposed on left and right sides of the bottom portion, and a pair of joint ends that are respectively continuous with the left and right side wall portions.

The upper die and the lower die are configured to form a plurality of second out-of-plane deformed portions together with the first out-of-plane deformed portions, the second out-of-plane deformed portions are formed in regions of the workpiece corresponding to the side wall portions and arranged along the longitudinal direction, each of the second out-of-plane deformed portions has a recessed shape or a protruding shape, and the bent portions are formed at boundaries between the bottom portion and the side wall portions.

Side surfaces of the punch and side surfaces of the dies squash the second out-of-plane deformed portions.

(6) We provide the apparatus to manufacture a closed-structure part according to (4) or (5), wherein, before bending the bent portion by clamping the bottom portion of the workpiece between the pad and the punch, a bulkhead is set on the bottom portion of the workpiece.

The plurality of first out-of-plane deformed portions are thus formed beforehand in the bottom portion along the longitudinal direction to increase the line length along the longitudinal direction, and then the workpiece is press-formed by using the punch, which has a curved surface at a bottom thereof, into a curved shape in which the bottom portion is curved. Thus, the bottom portion can be formed into a shape having an intended curved surface by allowing the bottom portion to extend in the longitudinal direction due to squashing of the first out-of-plane deformed portions.

As a result, while reducing the manufacturing cost by reducing the number of forming steps and the number of dies, a press-formed closed-structure part having a curved surface at the bottom portion can be formed with high precision.

By further forming the second out-of-plane deformed portions beforehand in the side wall portions to allow the side wall portions to extend due to squashing of the second out-of-plane deformed portions, a press-formed closed-structure part having a curved shape more precisely closer to an intended shape can be formed.

By setting a bulkhead before forming a closed section, the bulkhead can be easily set in a press-formed closed-structure part.

REFERENCE SIGNS LIST

Figure 1:
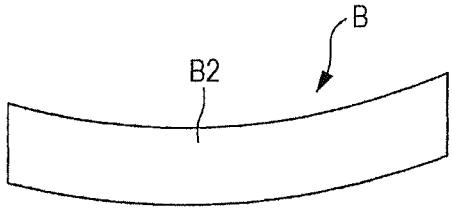
FIG. 1 illustrates a press-formed closed-structure part that has been formed by using a press-forming method according to a first structure, FIG. 1(*a*) showing a side view, and FIG. 1(*b*) showing a perspective view.
Figure 1:
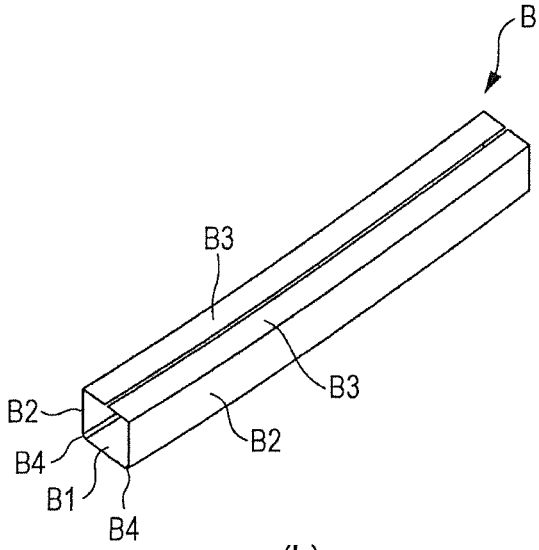

1 lower die
1*a* bottom forming portion
1*b* side wall forming portion
1*c* upright surface
2 upper die
3 punch
3*a* lower end surface
4 pad
4*a* upper surface
5 die
5*a* side surface of die
10 first out-of-plane deformed portion
11 second out-of-plane deformed portion
15 bulkhead setting hole
16 bulkhead
16*a* upright portion
16*b*, 16*c* side piece
16*d* insertion piece
17 inclined surface
B workpiece
B1 bottom portion
B2 side wall portion
B3 joint end (welding end)
B4 bent portion
B5 joint surface

DETAILED DESCRIPTION

Next, selected examples will be described with reference to the drawings.

First Structure

First, a first structure will be described.

As a flat plate-shaped workpiece B (also referred to as a blank), for example, a metal sheet or a metal plate formed by shearing or cutting the metal sheet into a blank shape corresponding to the shape of a product to be formed can be used. Examples of the metal sheet include a hot-rolled steel sheet; a cold-rolled steel sheet; a hot-rolled or a cold-rolled steel sheet having a coating (electrogalvanized coating, hot-dip galvanized coating, aluminized coating, or the like); and a metal sheet made of SUS, aluminum, magnesium, or the like. When using a hot-dip galvanized steel sheet, the steel sheet may be alloyed. Furthermore, any of such coated steel sheets may be further surface-treated (to form an organic coating or the like). When using a steel sheet as the metal plate, not only a mild steel sheet but also a hard steel sheet (high tensile strength steel sheet, super high tensile strength steel sheet) may be used. The press-forming method is preferably used to form a high tensile strength steel sheet and a super high tensile strength steel sheet.

With the press-forming method, the flat plate-shaped workpiece B is formed into a part having, for example, any of the following cross-sectional shapes (closed sections): a polygon, such as a quadrangle, a pentagon, an octagon (or a substantially polygonal shape similar to any of these); and a round shape, such as a circle, an ellipse (or a substantially circular or elliptical shape similar to any of these). Note that, after having been formed, a press-formed part has a closed structure having a shape that is curved downward along the longitudinal direction.

A closed structure includes joint ends B3 (also referred to as "welding ends" in the present specification), where the ends are finally to be joined together. The joint ends B3 can be joined together not only by welding such as laser welding or arc welding, but also by using rivets, bolts, an adhesive, or the like, as appropriate. In the examples described below, the joint ends B3 are joined together by welding.

In the examples described below, a press-formed closed-structure part made by press-forming a flat plate-shaped workpiece B has a cross-sectional shape that is substantially quadrangular as illustrated in FIG. 1. Note that, as illustrated in FIG. 1(*a*), the press-formed part has a shape that is curved along the longitudinal direction.

Structure of Apparatus

As described above, a manufacturing apparatus forms a flat plate-shaped workpiece B into a closed structure including a bottom portion B1, left and right side wall portions B2, and a pair of welding ends B3 (flanges). The bottom portion B1 is formed near the center of the workpiece B in the width direction. The left and right side wall portions B2 are formed on both sides of the bottom portion B1 in the width direction. The pair of welding ends B3 are respectively continuous with the left and right side wall portions B2. Moreover, the manufacturing apparatus press-forms the side wall portions B2 into curved shapes that are downwardly curved along the longitudinal direction (see FIG. 1).

The manufacturing apparatus includes a press-forming die for a first forming step and a bending die for a second forming step.

Figure 2:
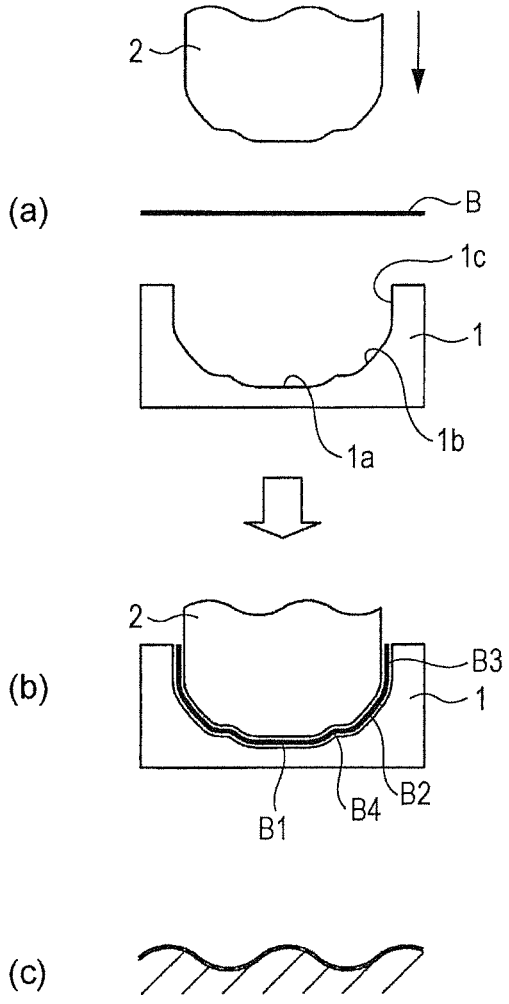
FIG. 2 illustrates dies used and press-forming performed in a first forming step according to the first structure.

As illustrated in FIG. 2, which is a schematic view, the press-forming die includes a lower die 1 and an upper die 2 that press-form a flat plate-shaped workpiece B by clamping the workpiece B therebetween.

An upper surface of the lower die 1 includes a press-forming surface that is open upward. In other words, the press-forming surface has a substantially angular-U-shaped cross section whose recessed portion faces upward. The press-forming surface includes a bottom forming portion 1*a* at substantially the center in the width direction and side wall forming portions 1*b* on the left and right sides of the bottom forming portion 1*a*. Upright surfaces 1*c* for forming welding ends, which include flanges, are disposed outside of the side wall forming portions 1*b*.

As illustrated in FIG. 2(*c*), in a side view, undulating recessed/protruding shapes are formed in the bottom forming portion 1*a* to be arranged along the longitudinal direction. Each of the recessed shapes and the protruding shapes has an arc-shape in a side view. A recessed shape and a protruding shape that are located adjacent to each other are connected to each other through a smoothly curved surface so that the curvature does not abruptly change. The portions of the press-forming surface having the recessed shapes and the protruding shapes are used to form first out-of-plane deformed portions 10.

Each of the recessed shapes and the protruding shapes extends in the width direction and is continuously formed in the side wall forming portions 1*b*. The portions of the side wall forming portions 1*b* having the recessed shapes and the protruding shapes are used to form second out-of-plane deformed portions 11. Each of the recessed shapes and the protruding shapes formed in the side wall forming portions 1*b* has a width in the longitudinal direction that decreases outward in the width direction.

Steep portions are formed along boundaries between the bottom forming portion 1*a* and the side wall forming portions 1*b*, and bent portions B4 are formed at corresponding boundaries described above.

The side wall forming portions 1*b* are inclined with respect to the bottom forming portion 1*a*.

The upper die 2 has such a shape that the upper die 2 can be inserted into the press-forming surface of the lower die 1. A lower surface and left and right end surfaces in the width direction of the upper die 2 are press-forming surfaces. The lower surface of the upper die 2, which is one of the press-forming surfaces, has a shape corresponding to the shape of the upper surface of the lower die 1 (press-forming surface) facing the lower surface of the upper die 2. In other words, a protruding bottom forming portion is formed at the center in the width direction, and side wall forming portions are formed on the left and right sides of the bottom forming portion.

A workpiece B is press-formed by inserting the upper die 2 toward the lower die 1 while the workpiece B is disposed between the lower die 1 and the upper die 2.

Figure 3:
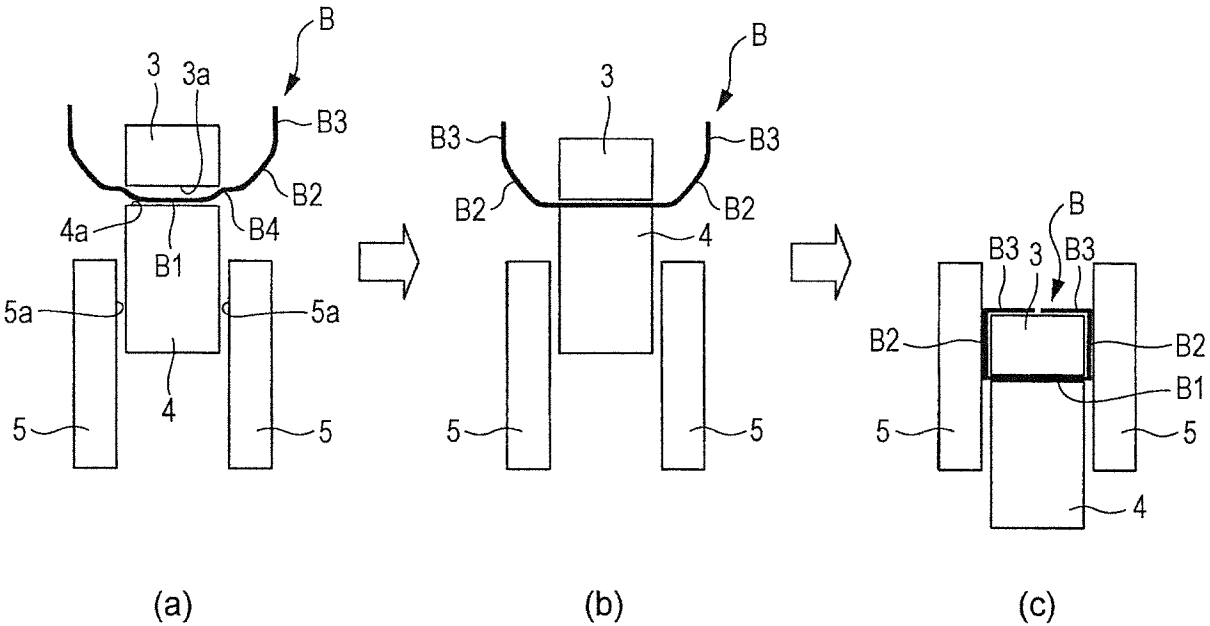
FIG. 3 illustrates dies used and bend-press-forming performed in a second forming step according to the first structure.

As illustrated in FIG. 3, which is a schematic view, the bending die includes a punch 3, a pad 4, and a pair of dies 5.

Figure 4:
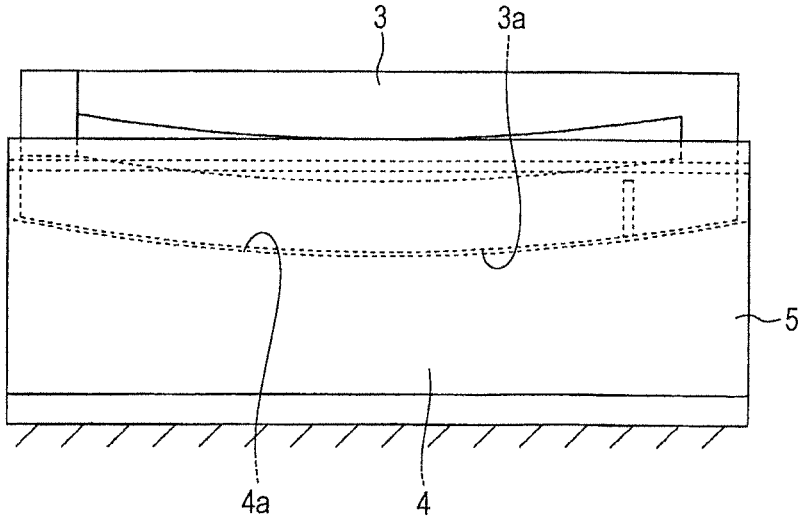
FIG. 4 is a side view of the dies used in the second first forming step of the first structure.

The cross-sectional shape of a pressing portion of the punch 3, that is, the cross-sectional shape of a lower end surface 3*a*, is the same as that of the bottom portion B1 of a closed structure to be formed. In other words, as illustrated in FIG. 4, the lower end surface 3*a* has a gently curved shape that is downwardly curved along the longitudinal direction. The side surfaces of the pressing portion of the punch 3 have flat shapes.

The pad 4 faces the punch 3 in the vertical direction, and an upper surface 4*a* of the pad 4 has a shape corresponding to that of the lower end surface of the punch 3.

The pair of dies 5 face each other with a distance corresponding to the width of the bottom portion B1 therebetween. When the punch 3 is pressed into a space between the pair of dies 5, the dies 5 bend the side wall portions B2 in such a way that the side wall portions B2 are bent around the bent portions B4 in directions in which the left and right side wall portions B2 become closer to each other. The shapes of the pair of dies 5 in the longitudinal direction correspond to the shape of the part after being formed.

Manufacturing Method

Next, a method of manufacturing a closed-structure part by using the manufacturing apparatus will be described.

In structure, a workpiece B, which is a flat metal plate, is press-formed into a press-formed closed-structure part through a two-step press-forming process. Subsequently, a welding-assembly step is performed.

It is assumed that the process is used to manufacture a front pillar reinforcement of an automobile. The manufacturing process of the part includes the following two steps: (1) a forming step, and (2) a welding-assembly step.

(1) Forming Step

The forming step is divided into a first forming step and a second forming step.

(1-1) First Forming Step

The first forming step is a step of forming the recessed/protruding portions and the bent portions B4. The recessed/protruding portions, which will become the first and second out-of-plane deformed portions 10 and 11, are formed in regions of a flat plate-shaped workpiece B (blank) corresponding to the bottom portion B1 and the side wall portions B2.

In other words, as illustrated in FIG. 2, the upper die 2 is inserted toward the lower die 1 while the flat plate-shaped workpiece B is disposed between the lower die 1 and the upper die 2 (FIG. 2(*a*)), thereby press-forming the workpiece B (FIG. 2(*b*)).

Figure 5:
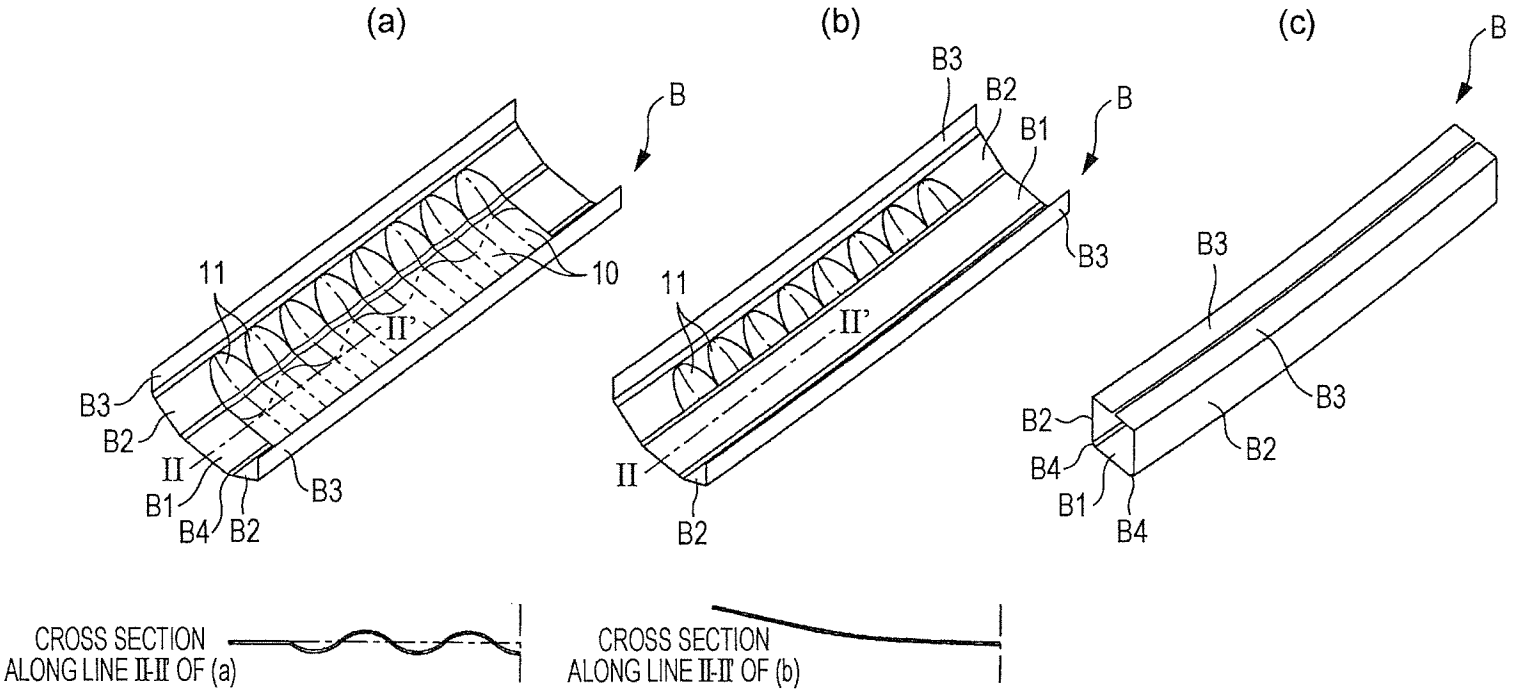
FIG. 5 illustrates a process of forming of a workpiece according to the first structure.

At this time, as illustrated in FIG. 5(*a*), the bent portions B4 are formed at the boundaries between the bottom portion B1 and the side wall portions B2, and the left and right side wall portions B2 are formed so as to extend diagonally upward from the bottom portion B1.

The recessed/protruding shapes of the bottom forming portion 1*a* and the side wall forming portions 1*b* are transferred to the workpiece B. Thus, the first out-of-plane deformed portions 10, each having a recessed shape or a protruding shape, are formed in a region corresponding to the bottom portion B1 to be arranged in the longitudinal direction (FIG. 5(*a*)). At the same time, the second out-of-plane deformed portions 11, each having a recessed shape or a protruding shape, are formed in regions corresponding to the left and right side wall portions B2, which are located on the left and right sides to be arranged in the longitudinal direction.

It is preferable that, along the width direction of the workpiece B, each of the first out-of-plane deformed portions 10 and the second out-of-plane deformed portions 11 that are located on both sides of the first out-of-plane deformed portion 10 be continuous with each other. In this structure, each of the first out-of-plane deformed portions 10 extends in the width direction. In other words, boundaries between adjacent first out-of-plane deformed portions 10 extend in the width direction.

As the number of the first out-of-plane deformed portions 10 formed along the longitudinal direction increases, the first out-of-plane deformed portions 10 can be squashed so as to extend more uniformly in the longitudinal direction. Accordingly, although it depends on the degree of downward curvature, for example, it is preferable that the number of the first out-of-plane deformed portions 10 is six or more.

The shapes and the number of the second out-of-plane deformed portions 11, which are arranged in the longitudinal direction, are determined beforehand so that the line length of each of the second out-of-plane deformed portions 11 along the longitudinal direction of the side wall portions B2 decreases with increasing distance from the bottom portion B1.

In other words, draw/stretch forming is performed so that a part has the sectional lengths of a final shape after being formed. Moreover, the first and second out-of-plane deformed portions 10 and 11 are formed so that, when forming curved surfaces at the upper and lower directions in a side view, the differences of line lengths of the upper and lower surfaces can be made small or zero.

(1-2) Second Forming Step

Next, the undulating recessed/protruding surface of the panel bottom portion B1 (the first out-of-plane deformed portions 10), which has been formed in the first forming step, is clamped between the pad 4 and the punch 3, and the punch 3 is pressed into a space between the pair of dies 5 while applying a load to the pad 4 and the punch 3. The load applied at this time may be variable.

At this time, as illustrated in FIGS. 3(*a*) and 3(*b*), by applying a load to the pad 4 and the punch 3, as illustrated in FIG. 5(*b*), the bottom portion B1 is formed into a shape corresponding to the forming surface of the punch 3, that is, a curved shape that is downwardly curved along the longitudinal direction, while the first out-of-plane deformed portions 10 are squashed.

Moreover, as illustrated in FIGS. 3(*b*) and 3(*c*), by pressing the punch 3 into the space between the dies 5, as illustrated in FIG. 5(*c*), the side wall portions B2 are erected to form vertical walls while the second out-of-plane deformed portions 11 of the side wall portions B2 are squashed, thereby forming a closed structure.

(2) Welding-Assembly Step

Butting portions at the upper surface in a side view of the press-formed part, which has been formed into a closed structure, are joined together by continuous welding, such as laser welding or arc welding.

Operations and Others

As illustrated in FIG. 5(*a*), to provide a punched bottom portion with a curved surface, that is, to form a press-formed part into a curved shape in a side view, in the first forming step, the first and second out-of-plane deformed portions 10 and 11, which have undulating recessed/protruding shapes, are formed by stretch-press-forming.

Next, in the second forming step, the press-formed part, which has been formed in the first forming step, is formed by using the punch 3 and the dies 5 illustrated in FIG. 3, which have curved surfaces of the final shape. In the second forming step, the undulating recessed/protruding surface (the first out-of-plane deformed portions 10) of the bottom portion of the panel B1, which has been formed in the first forming step, is clamped between the pad 4 and the punch 3, and the pad 4 and the punch 3 are pressed into a space between the dies 5 while applying a load to the pad 4 and the punch 3. At this time, the side wall portions B2 are erected to form vertical walls, while the second out-of-plane deformed portions 11, including the recessed/protruding portions of the side-surface portions of the panel, are squashed between the side surfaces of the dies 5 and the side surfaces of the punch 3, thereby forming the closed section (FIGS. 5(*b*) and 5(*c*)).

When the punch 3 reaches the bottom dead center, an upper side of the part in the side view are butted against another end surface in a slit (not shown) formed in the punch 3, thereby forming the closed section (FIG. 3(*c*)).

While the closed section is being formed, the upper surfaces in the side view become deformed so as to be wrapped around the punch 3. A supporting portion of the punch 3 has a slit (not shown) so that the workpiece may not interfere with the supporting portion of the punch 3. The press-formed part is removed from the punch 3 by opening a gate-like lock (not shown) disposed at an end surface of the punch 3 in the longitudinal direction and by extracting the punch 3 in the longitudinal direction.

Figure 6:
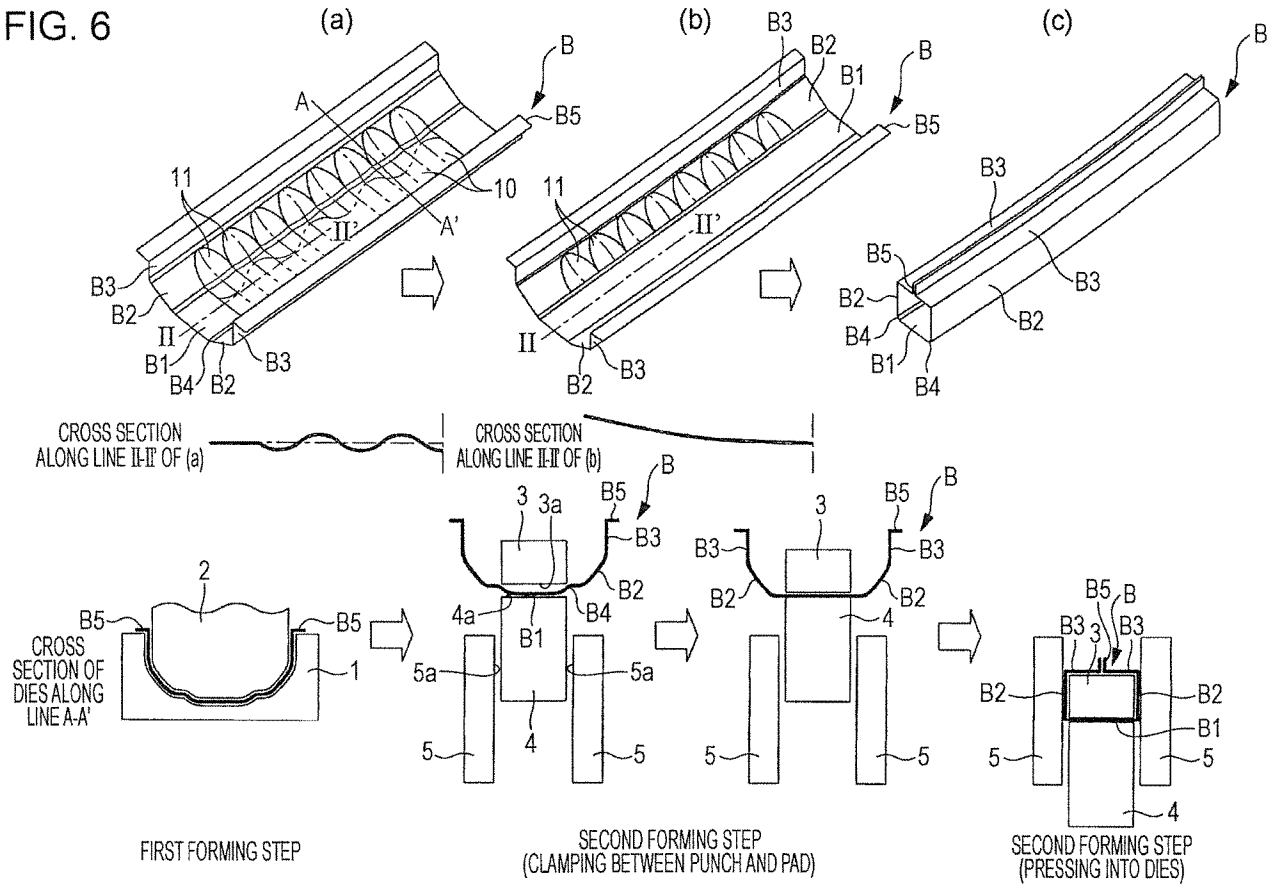
FIG. 6 illustrates a modification of the first structure.

As illustrated in FIG. 6, a pair of joint surfaces B5 may be formed beforehand in the workpiece B. By using the press-forming method, the pair of joint surfaces B5 can be positioned to face each other with high precision in a press-formed closed structure.

As heretofore described, a press-formed part having a curved shape can be manufactured with high precision from a single blank. As a result, a considerable cost reduction can be achieved because the number of dies is reduced and because the manufacturing process is simplified due to omission of an assembly step, and a weight reduction can be achieved because flanges are omitted.

In other words, in the first forming step, the plurality of first out-of-plane deformed portions 10 are formed beforehand in the bottom portion B1 along the longitudinal direction so as to increase the line length along the longitudinal direction, and then the workpiece is press-formed by using the punch 3, which has a curved surface at a bottom thereof, into a curved shape in which the bottom portion B1 is curved. At this time, the bottom portion B1 can be formed into a shape having an intended curved surface by allowing the bottom portion B1 to extend in the longitudinal direction due to squashing of the first out-of-plane deformed portions 10. As a result, while reducing the manufacturing cost by reducing the number of forming steps and the number of dies, a press-formed closed-structure part having a curved surface at the bottom portion B1 can be formed with high precision.

Furthermore, by forming the second out-of-plane deformed portions 11 beforehand in the side wall portions B2 to allow the side wall portions B2 to extend due to squashing of the second out-of-plane deformed portions 11, a press-formed closed-structure part having a curved shape more precisely closer to an intended shape can be formed.

It is preferable that the shapes of the first out-of-plane deformed portions 10 and the shapes of boundary portions between the first out-of-plane deformed portions 10 be formed not to have a part in which the curvature changes abruptly along the longitudinal direction and the width direction. The same applies to the second out-of-plane deformed portions 11.

In the structure described above, the first out-of-plane deformed portion 10 have a shape that is undulating along the longitudinal direction, that is, a shape in which recessed shapes and protruding shapes are continuously and alternately arranged. However, the shape of the first out-of-plane deformed portions 10 is not limited to this. For example, the first out-of-plane deformed portion 10 may have only recessed shapes or only protruding shapes. However, as described above, it is preferable that the boundary portions between the first out-of-plane deformed portions 10 corresponding to the bottom portion B1 be formed to have a curved surface shape that does not have a part in which the curvature changes abruptly along the longitudinal direction and the width direction.

Second Structure

Next, a second structure will be described with reference to the drawings. Structures and the like similar to those of the first structure will be denoted by the same numerals.

Figure 7:
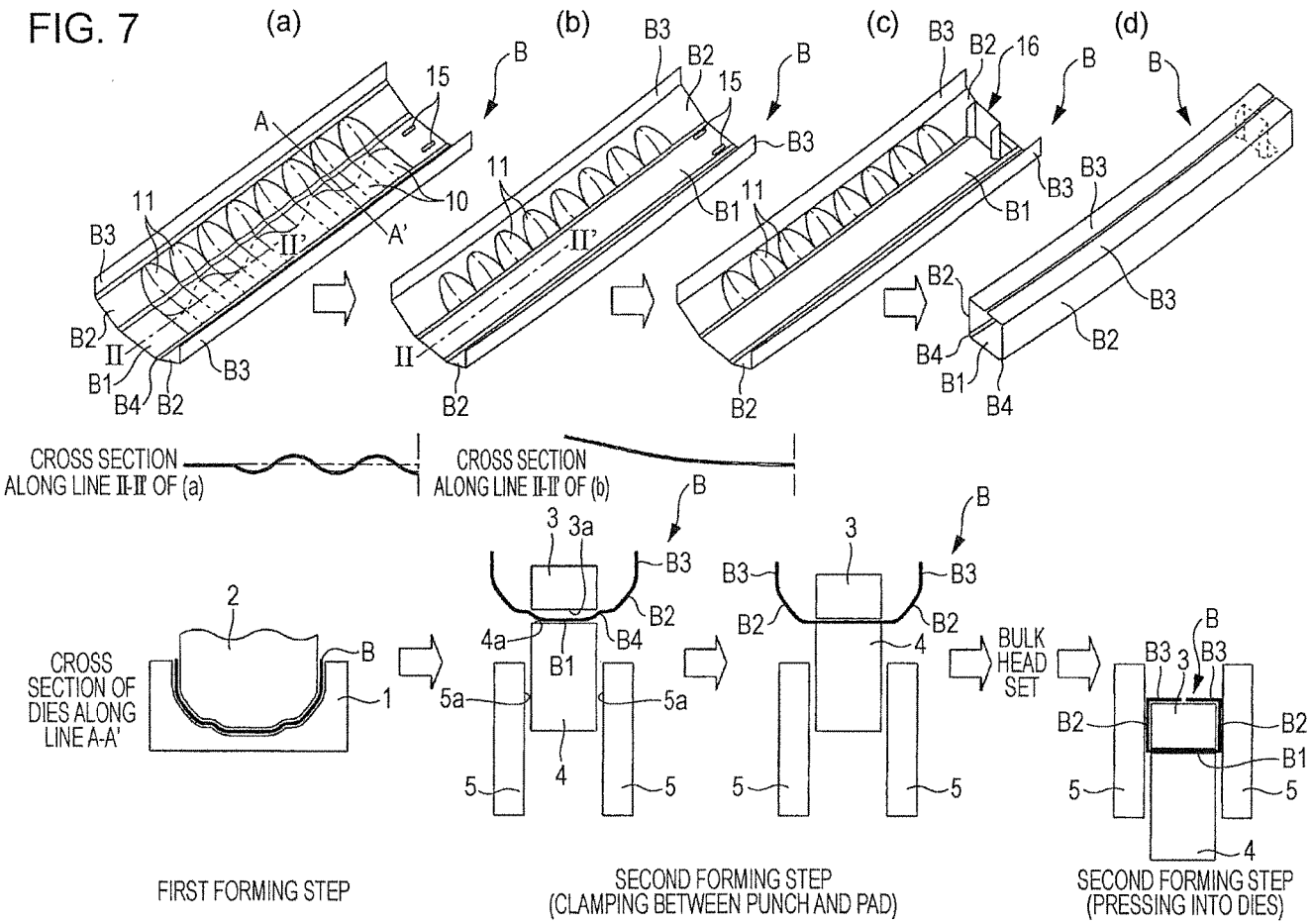
FIG. 7 illustrates a press-forming method according to a second structure.

As illustrated in FIG. 7, the basic structure of this structure is the same as that of the first structure. This structure differs from the first structure in that a bulkhead 16 is set after the first forming step has been performed.

In other words, a bulkhead setting step is performed between the first forming step and the second forming step.

Next, steps according to this structure will be described.

First Forming Step

The first forming step is the same as that of the first structure. However, as illustrated in FIG. 7(*a*), bulkhead setting holes 15 each having a slit shape are formed at positions outward in the longitudinal direction from a region in which the first out-of-plane deformed portions 10 are formed.

Before performing the second forming step, a bulkhead setting step described below is performed. Alternatively, an operation of setting a bulkhead may be performed in the second forming step. In this case, the operation of setting a bulkhead may be performed before the bent portion B4 is bent in the second forming step.

Bulkhead Setting Step

Figure 8:
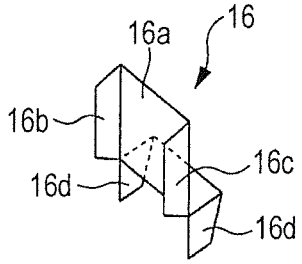
FIG. 8 is a perspective view illustrating an example of the structure of a bulkhead.

Apart from processing the workpiece B, a bulkhead 16 illustrated in FIG. 8 is prepared by processing another blank. As illustrated in FIG. 8, the bulkhead 16 includes a bulkhead body and insertion pieces 16*d*. The bulkhead body includes an upright portion 16*a* and left and right side pieces 16*b* and 16*c*. The upright portion 16*a*, which extends vertically upward, has a lower end portion that comes into contact with the bottom portion B1. The left and right side pieces 16*b* and 16*c* are continuous with side surfaces of the upright portion 16*a* and extend in a direction that intersects the plane of the upright portion 16*a*. The left and right side pieces 16*b* and 16*c* are configured to come into contact with the side wall portions B2. Thus, the bulkhead body is substantially angular-U-shaped in a top view. The bulkhead body further includes a bottom plate extending from the lower end portion of the upright portion 16*a*. The insertion pieces 16*d* are bent at both ends of the bottom plate in the width direction so as to protrude downward. The bulkhead 16 according to this structure, which has the structure described above, can be made from a single metal plate.

The workpiece B, which has been formed through the first forming step, is attached to a die set to set a bulkhead, and the bulkhead 16 is attached to the bottom portion B1 by inserting the insertion pieces 16*d* into the bulkhead setting holes 15 of the workpiece B from above (FIG. 7(*c*)). The bulkhead setting holes 15 are formed at such positions that, at this time, they are located outward in the longitudinal direction from a region of the workpiece B that will be clamped between a pad and a punch for setting a bulkhead. Note that FIG. 7 illustrates a die set that performs an operation of setting the bulkhead 16 in the second forming step.

By inserting the insertion pieces 16*d* into the bulkhead setting holes 15, the attachment position of the bulkhead 16 is determined and the bulkhead body stands on the bottom portion B1.

Then, a punch to set a bulkhead is lowered to bend the insertion pieces 16*d*, which protrude downward from the lower surface of the bottom portion B1, toward the bottom portion B1 by 90 degrees, thereby swaging the insertion pieces 16*d*. Thus, the bulkhead 16 is set. Subsequently, a robot or the like transfers the workpiece B to a die set of the second forming step, which will be performed next.

Figure 9:
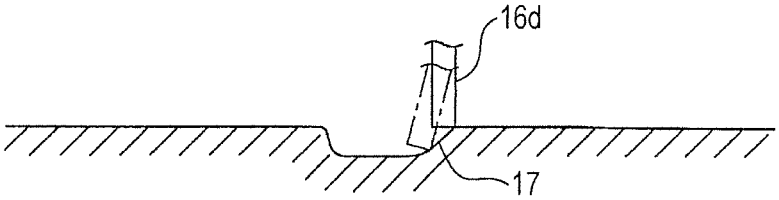
FIG. 9 is a schematic view illustrating how an insertion piece is bent.

As illustrated in FIG. 9, an inclined surface 17 is formed in a die surface of a die for setting the bulkhead, and the inclined surface 17 is configured to contact lower ends of the insertion pieces 16*d* from below when the insertion pieces 16*d* are lowered from above. When the lower ends of the insertion pieces 16*d* contact the inclined surface 17, the insertion pieces 16*d* are bent inward by the inclined surface 17, and thereby the insertion pieces 16*d* are bent toward the bottom portion B1 by 90 degrees.

Second Forming Step

The second forming step is the same as that of the first structure.

In other words, the undulating recessed/protruding surface (the first out-of-plane deformed portions 10) of the bottom portion B1, which has been formed through the first forming step, is clamped between the pad 4 and the punch 3, and the punch 3 is pressed into a space between the dies 5 while applying a load to the pad 4 and the punch 3. Then, the first out-of-plane deformed portions 10 formed in the bottom portion B1 are squashed between the pad 4 and the punch 3, and the side wall portions B2 are erected while the recessed/protruding portions (the second out-of-plane deformed portions 11) of the side-surface portions of the panel are squashed between side surfaces of the dies 5 and side surfaces of the punch 3, thereby forming a closed section. At this time, the side pieces 16*b* and 16*c* of the bulkhead 16 contact with the side wall portions B2, and therefore the side pieces 16*b* and 16*c* also serve as parts of the side surfaces of the punch 3.

A region of the punch 3 corresponding to the bulkhead 16 is recessed so that the bulkhead body can be prevented from receiving a load.

As described above, bending the insertion pieces 16*d* may be performed simultaneously with performing the second forming step.

Welding-Assembly Step

As in the first structure, butting portions at an upper surface in a side view of the press-formed part, which has a closed structure, are joined together by continuous welding such as laser welding or arc welding.

In this structure, after the insertion pieces 16*d* of the bulkhead 16 have been bent, the insertion pieces 16*d* may be joined to the press-formed product, which has a closed structure, by welding or by using an adhesive. Alternatively, the insertion pieces 16*d* may be only swaged.

Figure 10:
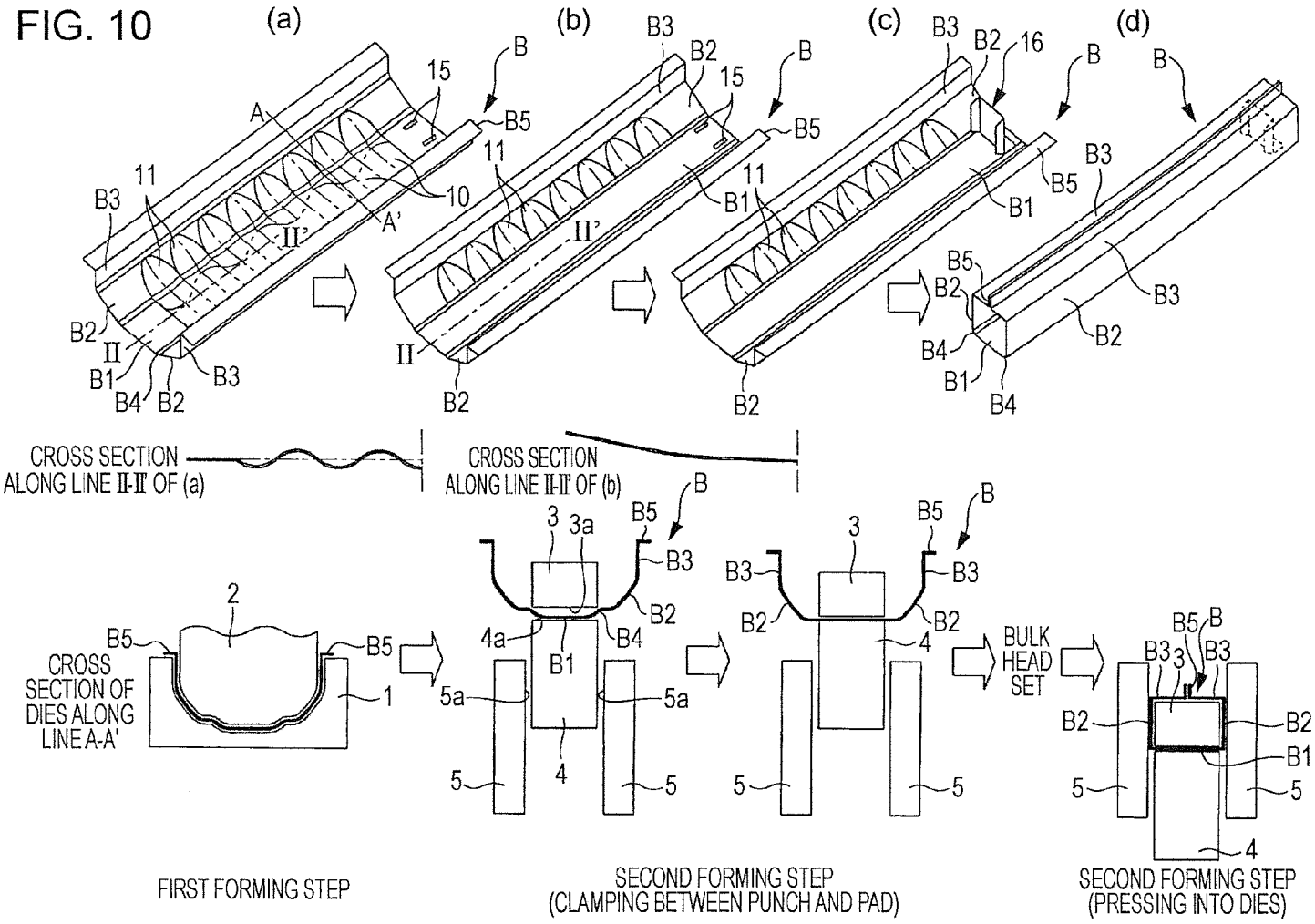
FIG. 10 illustrates a modification of the second structure.

As illustrated in FIG. 10, a pair of joint surface B5 may be formed beforehand in the workpiece B. By using the press-forming method according to this structure, the pair of joint surfaces B5 can be positioned so as to face each other with high precision in the press-formed closed structure.

Operations and Others

In addition to the operational effects described in the first structure, this structure has the following operational effects.

As in the first structure, a press-formed part having a curved shape and a closed structure can be manufactured from a single blank. As a result, a considerable cost reduction can be achieved because the number of dies is reduced and because the manufacturing process is simplified due to omission of an assembly step, and a weight reduction can be achieved because flanges are omitted.

As described above, the bulkhead 16 is set before the bent portions are bent in the second forming step. Thus, the bulkhead 16 can be attached to a press-formed part without forming openings for attaching the bulkhead 16 in the press-formed part after the press-formed part has been formed. As a result, the number of manufacturing steps can be reduced without impairing the performance of the press-formed part body.

Example 1

Next, examples based on the first structure will be described.

"Used Materials (Steel Grade, Composition, Dimensions, Etc.)"

Shape after being formed: quadrangular closed section part (front pillar upper reinforcement model) having a cross section of 40 mm H×30 mm W, L=300 mm. As described in the embodiments, a press-formed closed-structure part having a downwardly curved shape was formed.

First, conditions common to the examples are described.

"Used Steel Sheet"

A steel sheet having a tensile strength of 980 MPa (alloyed electrogalvanized coating (on both surfaces)), a thickness of 1.2 mm, and an amount of coating (on one surface) of 45 g/m$^2$ was used.

"Welding Method"

YAG laser welding was used in the welding-assembly step.

The welding conditions were as follows:

welding speed: 1500 mm/min,

YAG laser power: 3.5 kW, and focus diameter: 2 mm.

Under these common conditions, closed-structure parts were manufactured in the following three examples.

First Example

In the first example, the press-forming method illustrated in FIGS. 2 to 5 was used.

In the first forming step, in regions corresponding to the bottom portion B1 and the side wall portions B2, undulating recessed/protruding portions (the first and second out-of-plane deformed portions 10 and 11) were formed by stretch-press-forming. At this time, at end surfaces of the part, vertical flanges (joint ends B3) were formed at both ends of the steel plate, which were to become upper surfaces in a side view in the second forming step.

In the second forming step, by using the punch 3 and the dies 5 having curved surfaces corresponding to a shape to be formed, the undulating recessed/protruding surface (the first out-of-plane deformed portions 10) of the bottom portion B1, which had been formed in the first forming step, was clamped between the pad 4 and the punch 3 while applying a load of 50 tons, thereby squashing the recessed/protruding surface to form a camber (a curve along the longitudinal direction). While continuously applying a load of 50 tons to the pad 4 and the punch 3, the punch 3 was pressed into a space between the dies 5, so that the side wall portions B2 were erected while the recessed/protruding portions (the second out-of-plane deformed portions 11) of the side-surface portions of the panel were squashed between contact surfaces of side surfaces of the dies 5 and the punch 3. When the side wall portions B2 were erected, portions to become upper surfaces in the side view pass through a slit formed in the punch 3, thereby forming a closed section. The part was removed from the punch 3 by extracting the part in the longitudinal direction by using a removal mechanism disposed on a side surface of the punch 3. Subsequently, the joint ends were joined together by laser welding.

Second Example

In the second example, the press-forming method illustrated in FIG. 6 was used.

In the first forming step, in regions of the workpiece B corresponding to the bottom portion B1 and the side wall portions B2, undulating recessed/protruding portions (the first and second out-of-plane deformed portions 10 and 11) were formed by stretch-press-forming. At this time, at end surfaces of the part, flanges extending in the width direction were additionally formed at portions where vertical flanges were formed at both ends of the steel plate, which were to become upper surfaces in a side view in the second forming step.

In the second forming step, by using the punch 3 and the dies 5 having curved surfaces corresponding to a shape to be formed, the undulating recessed/protruding surface (the first out-of-plane deformed portions 10) of the bottom portion B1, which had been formed in the first forming step, was clamped between the pad 4 and the punch 3 while applying a load of 50 tons, thereby squashing the recessed/protruding surface to form a camber. While continuously applying a load of 50 tons to the pad 4 and the punch 3, the punch 3 was pressed into a space between the dies 5, so that the side wall portions B2 were erected while the recessed/protruding portions (the second out-of-plane deformed portions 11) of the side-surface portions of the panel were squashed between contact surfaces of side surfaces of the dies 5 and the punch 3.

When the side wall portions B2 were erected, portions to become upper surfaces in the side view pass through a slit formed in the punch 3, and the flanges are butted against each other, thereby forming a closed section. The part was removed from the punch 3 by extracting the part in the longitudinal direction by using a removal mechanism disposed on a side surface of the punch 3. Subsequently, the flanges were joined together by laser welding.

Comparative Example 1

Figure 11:
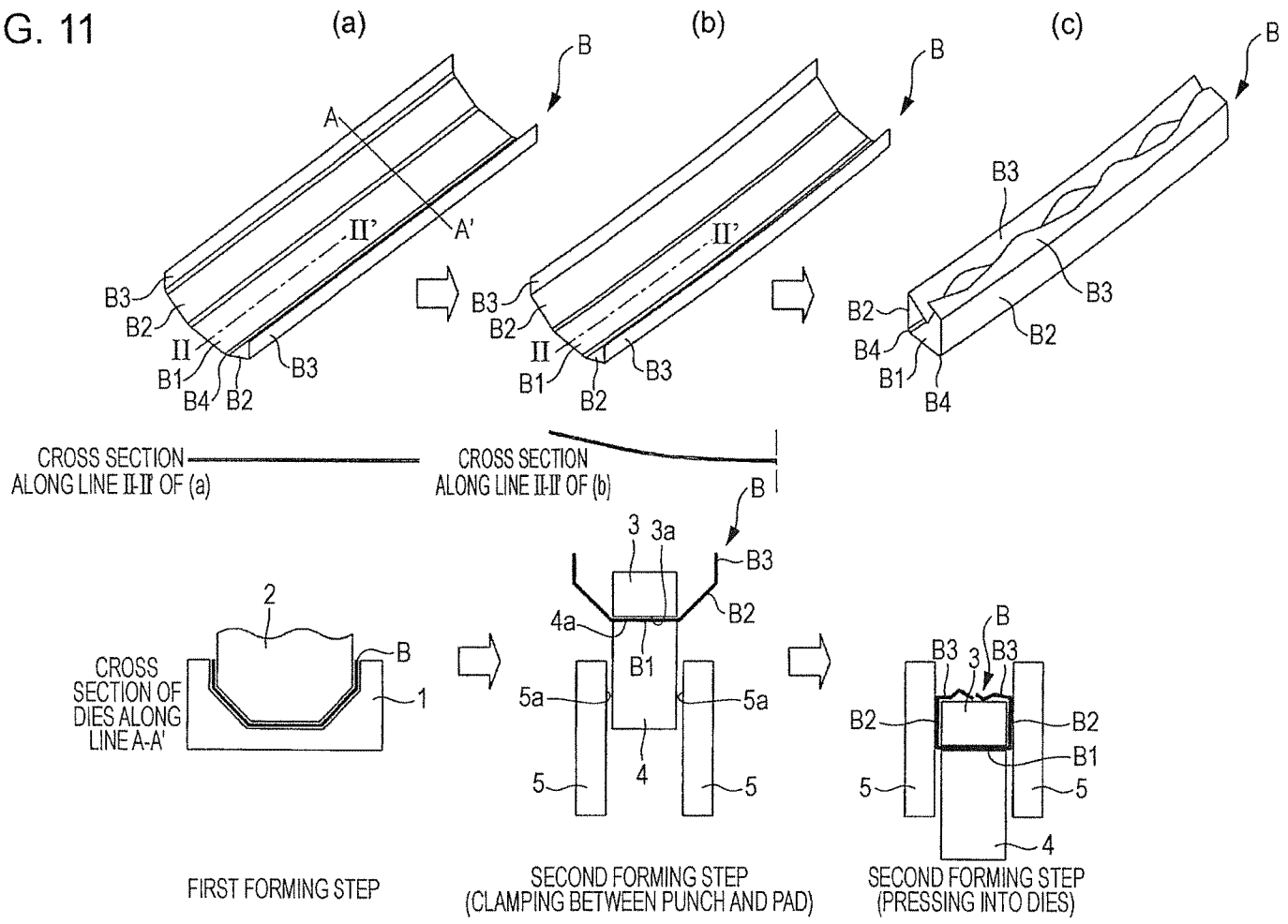
FIG. 11 illustrates a forming process according to a comparative example.

In comparative example 1, the press-forming method illustrated in FIG. 11 was used.

In the first forming step, in contrast to the first and second examples, in regions corresponding to the bottom portion B1 and the side wall portions B2, undulating recessed/protruding portions (the first and second out-of-plane deformed portions 10 and 11) were not formed by stretch-press-forming. At end surfaces of the part, vertical flanges were formed at both ends of the steel plate, which were to become upper surfaces in a side view in the second forming step.

In the second forming step, by using the punch 3 and the dies 5 having curved surfaces corresponding to a shape to be formed, the bottom portion B1, which had been formed in the first forming step, was clamped between the pad 4 and the punch 3 while applying a load of 50 tons and pressed into a space between the dies 5, thereby erecting the side portions B2. When the side wall portions B2 were erected, portions to become upper surfaces in the side view pass through a slit formed in the punch 3, thereby forming a closed section. The part was removed from the punch 3 by extracting the part in the longitudinal direction by using a removal mechanism disposed on a side surface of the punch 3. Subsequently, the joint ends were joined together by laser welding.

"Evaluations"

In the first and second examples, when press-forming a closed structure having a shape that is curved along the longitudinal direction, the pair of welding ends could be butted against each other with high precision. In contrast, in comparative example 1, because the pair of welding ends were considerably misaligned with each other, it was necessary to additionally perform a step of aligning the butting surfaces of the pair of welding ends.

Thus, by using this example, as compared to the comparative example, the number of steps and the number of dies can be reduced.

By using our examples, the part could be formed without causing breakage or wrinkling in the outer shape of the part in each of the examples. In contrast, wrinkling occurred in the comparative example 1.

Example 2

Next, examples based on the second structure will be described.

Used materials and conditions such as welding conditions were the same as those of Example 1 described above, and closed-structure parts were manufactured in the following three examples.

Third Example

In the third example, the press-forming method illustrated in FIG. 7 was used.

In the first forming step, in regions corresponding to the bottom portion B1 and the side wall portions B2, undulating recessed/protruding portions (the first and second out-of-plane deformed portions 10 and 11) were formed by stretch-press-forming. At this time, at end surfaces of the part, vertical flanges were formed at both ends of the steel plate, which were to become upper surfaces in a side view in the second forming step.

In the bulkhead setting step, the bulkhead 16, which had been formed, and the part that had been formed in the first forming step was set in a die set disposed at a certain position in the dies 5; the positions of the bulkhead setting hole and the bulkhead 16 were adjusted with each other; and the insertion pieces 16*d* of the bulkhead 16 were inserted into the bulkhead setting holes formed in the bottom portion B1. Next, the punch 3 was lowered to bend the insertion pieces 16*d*, protruding downward from the lower surface of the bottom portion B1, toward the bottom portion B1 by 90 degrees, thereby setting the bulkhead 16.

Next, in the second forming step, by using the punch 3 and the dies 5 having curved surfaces corresponding to the shape to be formed, the undulating recessed/protruding surface (the first out-of-plane deformed portions 10) of the bottom portion B1, which had been formed in the first forming step, was clamped between the pad 4 and the punch 3 while applying a load of 50 tons, thereby squashing the recessed/protruding surface to form a camber. While continuously applying a load of 50 tons to the pad 4 and the punch 3, the punch 3 was pressed into a space between the dies 5, so that the side wall portions B2 were erected while the recessed/protruding portions (the second out-of-plane deformed portions 11) of the side-surface portions of the panel were squashed between contact surfaces of side surfaces of the dies 5 and the punch 3. When the side wall portions B2 were erected, portions to become upper surfaces in the side view pass through a slit formed in the punch 3, thereby forming a closed section. The part was removed from the punch 3 by extracting the part in the longitudinal direction by using a removal mechanism disposed on a side surface of the punch 3. Subsequently, the joint ends were joined together by laser welding.

Fourth Example

In the fourth example, the press-forming method illustrated in FIG. 10 was used.

In the first forming step, in regions corresponding to the bottom portion B1 and the side wall portions B2, undulating recessed/protruding portions (the first and second out-of-plane deformed portions 10 and 11) were formed by stretch-press-forming. At this time, at end surfaces of the part, flanges extending in the width direction were additionally formed at portions where vertical flanges were formed at both ends of the steel plate, which were to become upper surfaces in a side view in the second forming step.

In the bulkhead setting step, the bulkhead 16, which had been formed, and the part that had been formed in the first forming step was set in a die set disposed at a certain position in the dies 5; the positions of the bulkhead setting hole and the bulkhead 16 were adjusted with each other; and the insertion pieces 16*d* of the bulkhead 16 were inserted into the bulkhead setting holes formed in the bottom portion B1. Next, the punch 3 was lowered to bend the insertion pieces 16*d*, protruding downward from the lower surface of the bottom portion B1, toward the bottom portion B1 by 90 degrees, thereby setting the bulkhead 16.

In the second forming step, by using the punch 3 and the dies 5 having curved surfaces corresponding to the shape to be formed, the undulating recessed/protruding surface (the first out-of-plane deformed portions 10) of the bottom portion B1, which had been formed in the first forming step, was clamped between the pad 4 and the punch 3 while applying a load of 50 tons, thereby squashing the recessed/protruding surface to form a camber. While continuously applying a load of 50 tons to the pad 4 and the punch 3, the punch 3 was pressed into a space between the dies 5, so that the side wall portions B2 were erected while the recessed/protruding portions (the second out-of-plane deformed portions 11) of the side-surface portions of the panel were squashed between contact surfaces of side surfaces of the dies 5 and the punch 3. When the side wall portions B2 were erected, portions to become upper surfaces in the side view pass through a slit formed in the punch 3, and the flanges are butted against each other, thereby forming a closed section. The part was removed from the punch 3 by extracting the part in the longitudinal direction by using a removal mechanism disposed on a side surface of the punch 3. Subsequently, the flanges were joined together by laser welding.

Comparative Example 2

Figure 12:
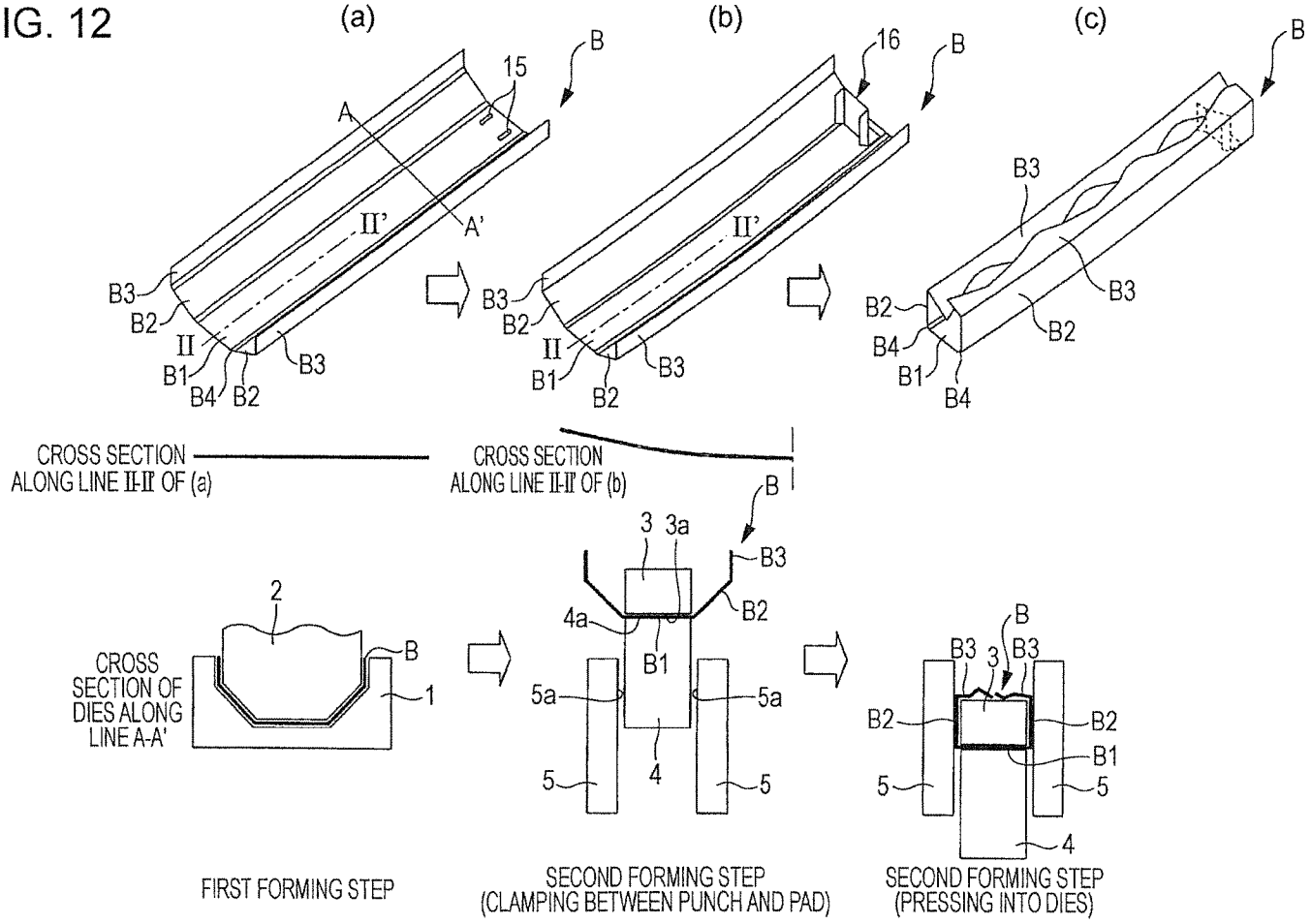
FIG. 12 illustrates a forming process according to a comparative example.

In comparative example 2, the press-forming method illustrated in FIG. 12 was used.

In the first forming step, in contrast to the third and fourth examples, in regions corresponding to the bottom portion B1 and the side wall portions B2, undulating recessed/protruding portions (the first and second out-of-plane deformed portions 10 and 11) were not formed by stretch-press-forming. At end surfaces of the part, vertical flanges were formed at both ends of the steel plate, which were to become upper surfaces in a side view in the second forming step.

In the bulkhead setting step, the bulkhead 16, which had been formed, and the part that had been formed in the first forming step was set in a die set disposed at a certain position in the dies 5; the positions of the bulkhead setting hole and the bulkhead 16 were adjusted with each other; and the insertion pieces 16*d* of the bulkhead 16 were inserted into the bulkhead setting holes formed in the bottom portion B1. Next, the punch 3 was lowered to bend the insertion pieces 16*d*, protruding downward from the lower surface of the bottom portion B1, toward the bottom portion B1 by 90 degrees, thereby setting the bulkhead 16.

In the second forming step, by using the punch 3 and the dies 5 having curved surfaces corresponding to the shape to be formed, the bottom portion B1, which had been formed in the first forming step, was clamped between the pad 4 and the punch 3 while applying a load of 50 tons and pressed into a space between the dies 5, thereby erecting the side portions B2. When the side wall portions B2 were erected, portions to become upper surfaces in the side view pass through a slit formed in the punch 3, thereby forming a closed section. The part was removed from the punch 3 by extracting the part in the longitudinal direction by using a removal mechanism disposed on a side surface of the punch 3. Subsequently, the flanges were joined together by laser welding.

"Evaluation"

In the third and fourth examples, when press-forming a closed structure having a shape that is curved along the longitudinal direction, the pair of welding ends could be butted against each other with high precision. In contrast, in comparative example 2, because the pair of welding ends were considerably misaligned with each other, it was necessary to additionally perform a step of aligning the butting surfaces of the pair of welding ends.

Thus, by using our example, as compared to the comparative example, the number of steps and the number of dies can be reduced.

By using our examples the part could be formed without causing breakage or wrinkling in the outer shape of the part in each of the examples.

In contrast, wrinkling occurred in comparative example 2.

The invention claimed is:

1. A method of manufacturing a closed-structure part by forming a flat plate-shaped workpiece into the closed structure including a bottom portion curved along a longitudinal direction and left and right side wall portions, comprising:

a first forming step of forming a plurality of first out-of-plane deformed portions and bent portions at boundaries between a region of the workpiece corresponding to the bottom portion and regions of the workpiece corresponding to the left and right side wall portions that are disposed on left and right sides in a width direction of the bottom portion, the first out-of-plane deformed portions being formed in the region of the workpiece corresponding to the bottom portion and arranged along the longitudinal direction, each of the first out-of-plane deformed portions having a recessed shape or a protruding shape; and a second forming step of squashing each of the first out-of-plane deformed portions between a pad and a punch such that the region of the workpiece corresponding to the bottom portion is curved along the longitudinal direction and bending the bent portions by pressing the punch into a space between dies while the region of the workpiece corresponding to the bottom portion is clamped between the pad and the punch.

2. The method according to claim 1, wherein the second forming step is performed such that the region of the workpiece corresponding to the bottom portion is curved in a side view.

3. The method according to claim 2, wherein, after the first forming step has been finished and before the bent portions are bent in the second forming step, a bulkhead is set on the region of the workpiece corresponding to the bottom portion of the workpiece.

4. The method according to claim 1, wherein:

in the first forming step, a plurality of second out-of-plane deformed portions are formed together with the first out-of-plane deformed portions, the second out-of-plane deformed portions are formed in the regions of the workpiece corresponding to the left and right side wall portions and arranged along the longitudinal direction, each of the second out-of-plane deformed portions has a recessed shape or a protruding shape; and in the second forming step, the second out-of-plane deformed portions are squashed between side surfaces of the punch and side surfaces of the dies.

5. The method according to claim 4, wherein the second forming step is performed such that the region of the workpiece corresponding to the bottom portion is curved in a side view.

6. The method according to claim 4, wherein, after the first forming step is finished and before the bent portions are bent in the second forming step, a bulkhead is set on the region of the workpiece corresponding to the bottom portion of the workpiece.

7. The method according to claim 1, wherein, after the first forming step is finished and before the bent portions are bent in the second forming step, a bulkhead is set on the region of the workpiece corresponding to the bottom portion of the workpiece.

* * * * *